US006957458B2

(12) United States Patent
Nagaoka et al.

(10) Patent No.: US 6,957,458 B2
(45) Date of Patent: Oct. 25, 2005

(54) COORDINATIVE LIFTING CONTROL METHOD OF BOTTOM SECTIONS FOR LYING FURNITURE SUCH AS A BED

(75) Inventors: Hiroshi Nagaoka, Tokyo (JP); Masao Horitani, Tokyo (JP); Satoru Inoue, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 65 days.

(21) Appl. No.: 10/389,965

(22) Filed: Mar. 18, 2003

(65) Prior Publication Data

US 2003/0177580 A1 Sep. 25, 2003

(30) Foreign Application Priority Data

Mar. 18, 2002 (JP) ..... 2002-075078

(51) Int. Cl.[7] ..... A61G 7/018
(52) U.S. Cl. ..... 5/613; 5/616; 5/618
(58) Field of Search ..... 5/600, 613, 616–618

(56) References Cited

U.S. PATENT DOCUMENTS 5,611,096 A * 3/1997 Bartlett et al. ..... 5/617
5,771,511 A * 6/1998 Kummer et al. ..... 5/600
6,008,598 A * 12/1999 Luff et al. ..... 318/16
6,320,510 B2 * 11/2001 Menkedick et al. ..... 340/573.1
6,336,235 B1 * 1/2002 Ruehl ..... 5/610
6,566,833 B2 * 5/2003 Bartlett ..... 318/564

FOREIGN PATENT DOCUMENTS

EP 1180352 A1 * 2/2002
EP 1354539 A1 * 4/2003
EP 1350448 A2 * 10/2003
EP 1374821 A1 * 1/2004

* cited by examiner

*Primary Examiner*—Michael Trettel
(74) *Attorney, Agent, or Firm*—Townsend & Banta

(57) ABSTRACT

A method of controlling the coordinative lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that a pressure detecting means is interposed between the back bottom section and the back of the lying person, and when the back bottom section is pivotally rotated and lifted to be kept inclined from a flat state where all the bottom sections are kept down to lie flat, the knee bottom section is also adequately lifted, wherein the knee bottom section is controlled to decline when the pressure applied from the back bottom section to the back of the lying person and detected by said pressure detecting means has increased to a preset value.

5 Claims, 5 Drawing Sheets

COORDINATIVE LIFTING CONTROL METHOD OF BOTTOM SECTIONS FOR LYING FURNITURE SUCH AS A BED

FIELD OF THE INVENTION

The present invention generally relates to an coordinative lifting control method of bottom sections for lying furniture such as a bed (hospital bed, ICU bed, long term care bed, etc.) or a stretcher. In more detail, it relates to an coordinative lifting control method for lifting a back bottom section for lifting the back portion of a lying person and a knee bottom section for lifting his/her knee portion in an coordinative manner for achieving the following object, on lying furniture having the back bottom section and the knee bottom section.

BACKGROUND OF THE INVENTION (Prior Art)

Some of lying furniture such as beds and stretchers are respectively provided with a back bottom section for lifting the back portion of a lying person and a knee bottom section for lifting his/her knee portion, which can be respectively lifted by lifting mechanisms respectively provided for them.

Many examples of such lying furniture can be seen in U.S. Pat. Nos. 5,469,591, 5,448,789, 5,388,290, etc.

For example, the bed described in U.S. Pat. No. 5,469,591 has a back bottom section for lifting the back portion of a lying person, a knee bottom section for lifting his/her knee portion, and other bottom sections. On the undersides of the back bottom section and the knee bottom section, lifting arms each having a roller at the tip are installed pivotally rotatably, and the lifting arms can be driven and rotated by electric drive mechanisms such as motors.

In this constitution, the lifting arm of the back bottom section is pivotally rotated to let its roller lift the back bottom section in a pivotally rotating motion, for making it inclined, thereby lifting the back of the lying person, so that he/she can get up on the bed.

When the back bottom section is lifted and inclined like this, the lifting arm of the knee bottom section is pivotally rotated to let its roller lift the knee bottom section in a pivotally rotating motion, for making it inclined, thereby effectively preventing that the lying person slides forward if the back bottom section only is lifted.

That is, in the case where the person lying on the bed is lifted at his/her back, to get up, if the back bottom section is lifted, his/her body gradually slides forward since he/she is pressed forward at his/her back by the back bottom section. As a result, the point at which his/her body can be easily bent shifts from the pivot of the back bottom section. So, a force for bending the lumbar vertebra portion unlikely to be bent is applied from the back bottom section, to press the lumber vertebra portion and the abdominal portion of the lying person, making him/her feel displeasure.

Therefore, if the knee bottom section is lifted when the back bottom section is lifted, the body portion located above the inclined knee bottom section, i.e., femoral regions can receive the force applied from the back bottom section to press the lying person forward. As a result, the body sliding and displeasure feeling caused when his/her back only is lifted by means of the back bottom section can be prevented.

The conventional methods for also lifting the knee bottom section when lifting the back bottom section include, for example, the following.

a. As a first example, the drive mechanisms for lifting the back bottom section and the knee bottom section are operated respectively independently, and the lying person per se or a nurse simultaneously or alternately turns on and off the respective drive mechanisms, using, for example remote control switches, to lift the back bottom section and the knee bottom section respectively to desired positions.

b. As a second example, a common motor or the like is used to drive the drive mechanisms of the back bottom section and the knee bottom section using an interlocking mechanism such as a link mechanism, so that the drive mechanisms of the back bottom section and the knee bottom section can be actuated in a mechanically coordinative manner, to lift the back bottom section and the knee bottom section to predetermined positions.

(Problems of the Prior Art)

However, these conventional methods have the following problems.

A. In the method a, the lying person or a nurse must simultaneously or alternately operate the respective drive mechanisms of the back bottom section and the knee bottom section. This operation is very complicated and troublesome, and the operator must be accustomed to it. Furthermore, it is difficult to always reproduce the optimum lifting states respectively for the back bottom section and the knee bottom section.

B. In the method b, since an interlocking mechanism is used, the lifting states of the back bottom section and the knee bottom section achieved in an coordinative manner are inevitably simple and impossible to change, and it is difficult to efficiently prevent both the body sliding and the displeasure feeling such as pressure feeling.

SUMMARY OF THE INVENTION

This invention has been achieved in view of the above-mentioned problems. It provides lying furniture such as a bed that has a back bottom section for lifting the back portion of a lying person and a knee bottom section for lifting his/her knee portion, in which the respective bottom sections can be lifted by the lifting mechanisms respectively provided for them, wherein when the back bottom section is pivotally rotated and lifted to be kept inclined from a flat state where all the bottom sections are kept down to lie flat, both the body sliding and the displeasure feeling such as pressure feeling can be efficiently prevented.

At first, the first subject matter of this invention described in claim 1 proposes a method of controlling the coordinative lifting of bottom sections of lying furniture such as a bed that has a back bottom section for lifting the back portion of a lying person and a knee bottom section for lifting his/her knee portion, in which the respective bottom sections can be lifted by the lifting mechanisms respectively provided for them, characterized in that a pressure detecting means is interposed between the back bottom section and the back of the lying person, and when the back bottom section is pivotally rotated and lifted to be kept inclined from a flat state where all the bottom sections are kept down to lie flat, the knee bottom section is also adequately lifted, wherein the knee bottom section is controlled to decline when the pressure applied from the back bottom section to the back of the lying person and detected by said pressure detecting means has increased to a preset value.

In this method, when the back bottom section is pivotally rotated and lifted to be kept inclined from a flat state where all the bottom sections are kept down to lie flat, the knee bottom section is also lifted. Since the knee bottom section is lifted like this, the knee bottom section supports the position of the waist of the lying person. Therefore, in this state, even if the back bottom section is lifted and gradually inclined steeply, the lying person is prevented from sliding forward.

If the lifting of the back bottom section and the lifting of the knee bottom section are continued further without control, the angle formed between the back bottom section and the knee portion becomes gradually smaller, and as a result, the abdominal region of the lying person is gradually bent to let him/her feel a pressure.

However, in the first subject matter of this invention, the lifting of the knee bottom section is not continued further without control. In this invention, said pressure detecting means monitors the pressure applied from the back bottom section to the back of the lying person, and when the pressure has increased to a preset value, the knee bottom section is controlled to decline. So, it does not happen that the angle formed between the back bottom section and the knee bottom section becomes smaller than a certain angle.

Therefore, it can be prevented that the abdominal region of the lying person is gradually bent between both the bottom sections to let him/her feel a pressure.

As for the lifting of the back bottom section and the lifting of the knee bottom section to produce the above action, the lifting of the back bottom section and the lifting of the knee bottom section can be started simultaneously as in the second subject matter of this invention described in claim 2, or the lifting of the back bottom section can be started at first as in the third subject matter of this invention described in claim 3, or the lifting of the knee bottom section can be started at first as in the fourth subject matter of this invention described in claim 4.

Especially in the case of the forth subject matter of this invention described in claim 4, when the back bottom section is pivotally rotated and lifted to be kept inclined from a flat state where all the bottom sections are kept down to lie flat, the lifting of the knee bottom section is started at first. Since the knee bottom section is lifted, the knee bottom section positively supports the position of the waist of the lying person from the beginning. Therefore, even if the lifting of the back bottom section is started to make the back bottom section gradually steeply inclined, it can be prevented that the lying person slides forward.

In the case of the fifth subject matter of this invention described in claim 5, the preset value of pressure for the above-mentioned control action can be changed. So, the lifting of the knee bottom section can be controlled in response to the individual difference of the lying person in feeling the pressure.

DETAILED DESCRIPTION OF THE PREFERRED EMBODIMENTS

The preferred embodiments of this invention are described below in more detail in reference to the attached drawings.

Figure 1:
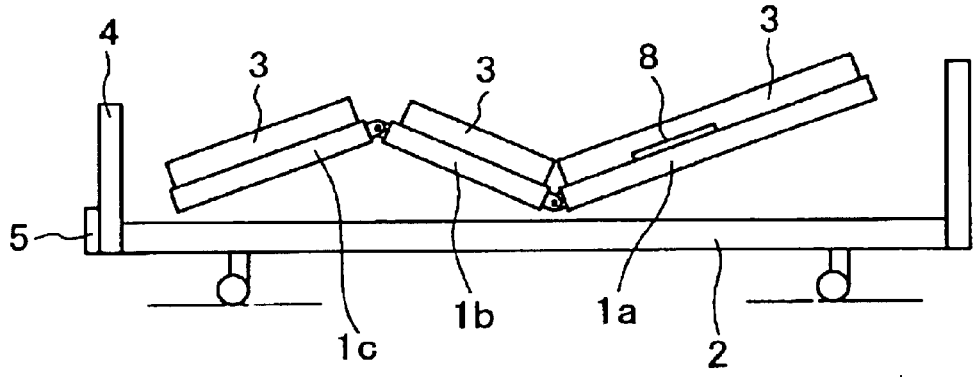
FIG. 1 is a side view showing, as an example, the entire bed to which the method of controlling the coordinative lifting of bottom sections of this invention is applied.

FIG. 1 is a side view showing, as an example, the entire bed to which the method of controlling the coordinative lifting of bottom sections of this invention is applied. The illustrated bed is composed of a back bottom section 1*a* for lifting the back portion of a lying person, a knee bottom section 1*b* for lifting his/her knee portion, and a leg bottom section 1*c* corresponding to his/her leg portion. The back bottom section 1*a,* the knee bottom section 1*b* and the leg bottom section 1*c* are connected with each other to form a bendable bottom corresponding to the whole body, and supported by a bed frame 2. Furthermore, respectively for the back bottom section 1*a,* the knee bottom section 1*b* and the leg bottom section 1*c,* mattresses 3 are provided. The mattresses 3 are separated in the drawing, but an integral mattress can also be used. The support mechanism for supporting and lifting the divided plural bottom sections on the bed frame 2 is not illustrated here since it is well known.

In the bed of this example, the bottom corresponding to the whole body is composed of the above-mentioned divided three bottom sections 1*a,* 1*b* and 1*c* connected with each other. However, the bottom can also be divided into four portions, or as described, for example, in the aforesaid U.S. Pat. Nos. 5,469,591, 5,448,789 and 5,388,290, many members can be connected with each other to form a bendable bottom. Anyway the bed to which this invention is applied is only required to have a back bottom section for lifting the back portion of the lying person and a knee bottom section for lifting his/her knee portion.

Furthermore, the lifting mechanisms for lifting the back bottom section 1*a* and the knee bottom 1*b* portion can be the mechanisms as described, for example, in the aforesaid U.S. Pat. Nos. 5,469,591, 5,448,789 and 5,388,290. That is, a lifting arm having a roller at the tip, which can be pivotally rotated by an electric drive mechanism such as a motor, can be installed to let the roller lift and support each bottom section, or a linear motion member with a rotary motion-linear motion conversion mechanism consisting of a threaded shaft and a female screw engaged with it can be connected with an arm installed on the underside of each bottom section.

The lifting mechanisms for lifting the back bottom section 1*a* and the knee bottom section 1*b* can be of course controlled to act in an coordinative manner as described later, or can also be controlled to actuate the respective bottom sections individually as required.

Figure 2:
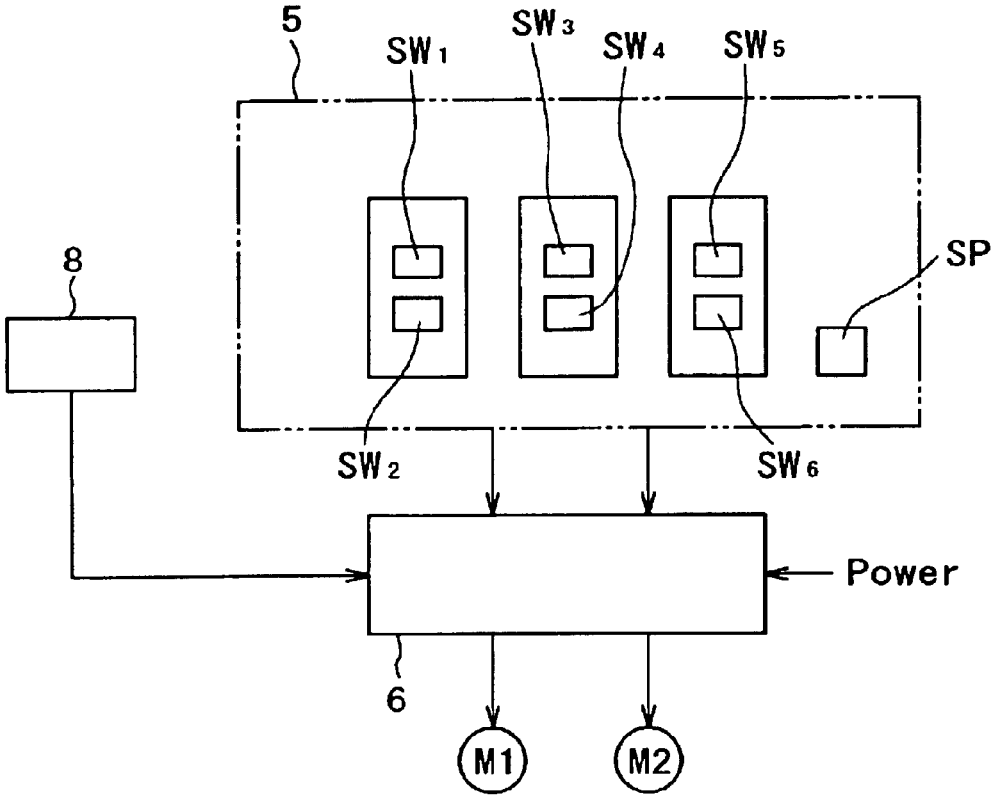
FIG. 2 is an illustration showing, as an example, the control mechanism of the bed to which the method of controlling the coordinative lifting of bottom sections of this invention is applied.

An example of the control mechanism for the bed to which the method of controlling the coordinative lifting of bottom sections of this invention is applied is described in reference to FIGS. 1 and 2. Symbol 4 denotes a footboard, and a control panel 5 is installed outside and below the footboard 4. The control panel 5 contains the control switches shown in FIG. 2.

The control panel 5 contains switches SW1 and SW2 for lifting and lowering the back bottom section 1*a* and switches SW3 and SW4 for lifting and lowering the knee bottom section 1*b*. These switches allow the back bottom section and the knee bottom section to be lifted and lowered independently.

The control panel 5 also contains switches for lifting and lowering the back bottom section 1*a* and the knee bottom section 1*b* in an coordinative manner, i.e., lifting and lowering switches SW5 and SW6 in addition to the above-mentioned switches.

On the other hand, the back bottom section 1*a* has a pressure detecting means 8 interposed between the back of the lying person and the back bottom section 1*a*. The pressure detecting means 8 can have any structure if it can detect the pressure applied from the back bottom section 1*a* to the back of the lying person, and, for example, can consist of an air pouch and a pressure sensor for detecting the pressure in the air pouch.

Symbol 6 denotes a controller that controls the on and off actions of the motors M1 and M2 used for lifting the back bottom section 1*a* and the knee bottom section 1*b*. The output signal of the pressure detecting means 8 is applied to the controller 6.

On the other hand, the control panel 5 has a pressure setting section SP for storing the preset value used for the controller 6 to judge whether the pressure applied from the pressure detecting means 8 reaches the preset value or not.

The above-mentioned constitution used for the coordinative action of the back bottom section and the knee bottom section described in claim 4 is described below.

Figure 3:
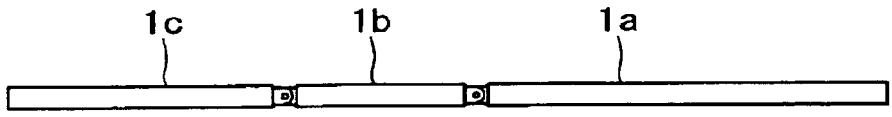
FIG. 3 is a side view showing the entire form of a bottom in a state where all the bottom sections are kept down to lie flat.

FIG. 3 shows a state where all the bottom sections 1*a*, 1*b* and 1*c* are kept down to lie flat, and in this state, a person such as a patient lies in an ordinary position. To let the lying person get up by lifting his/her back portion from this state, the switch SW5 is turned on to issue a command to the controller 6.

Figure 4:
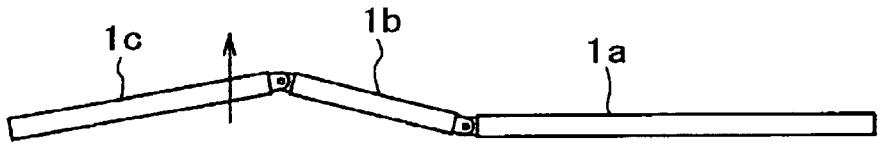
FIG. 4 is a side view showing the entire form of a bottom in one phase in the lifting action, in the case where the method of controlling the coordinative lifting of bottom sections of this invention is applied to a bed.

Receiving the command, the controller 6 actuates at first the lifting mechanism of the knee bottom section 1*b* as shown in FIG. 4, to start lifting the knee bottom section 1*b* only. The time instant when the lifting of the knee bottom section 1*b* is started is t=0 in FIG. 9.

Figure 5:
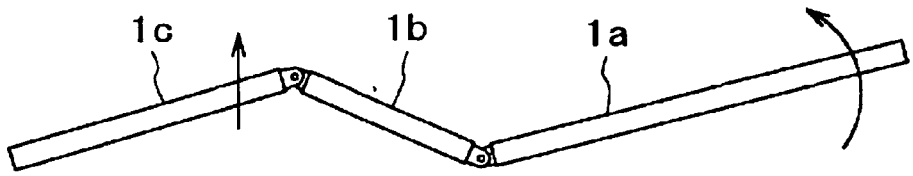
FIG. 5 is a side view showing the entire form of a bottom in another phase in the lifting action, in the case where the method of controlling the coordinative lifting of bottom sections of this invention is applied to a bed.
Figure 6:
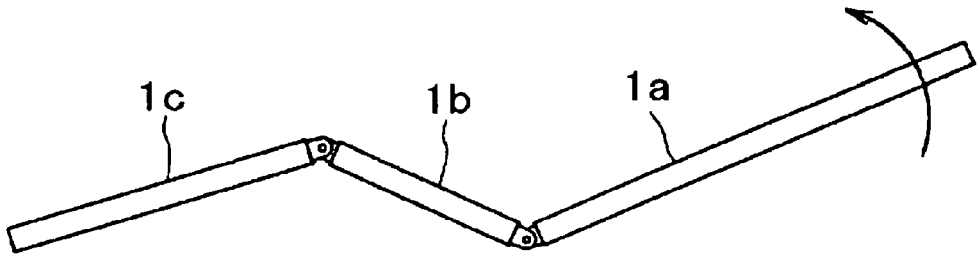
FIG. 6 is a side view showing the entire form of a bottom in a further other phase in the lifting action, in the case where the method of controlling the coordinative lifting of bottom sections of this invention is applied to a bed.
Figure 7:
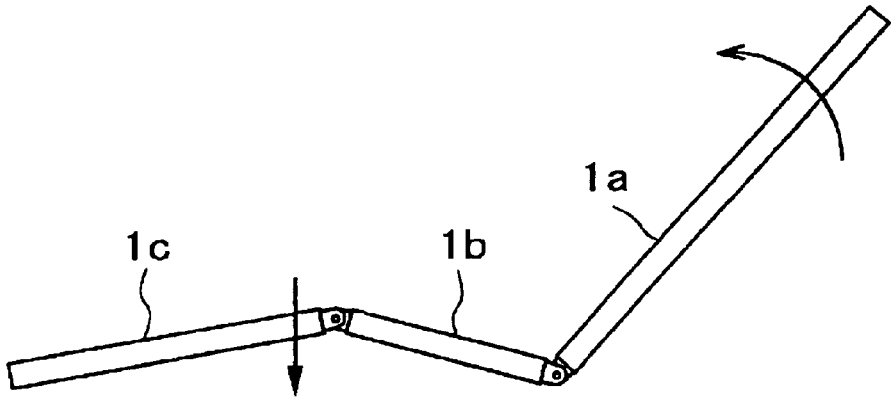
FIG. 7 is a side view showing the entire form of a bottom in a still further other phase in the lifting action, in the case where the method of controlling the coordinative lifting of bottom sections of this invention is applied to a bed.
Figure 8:
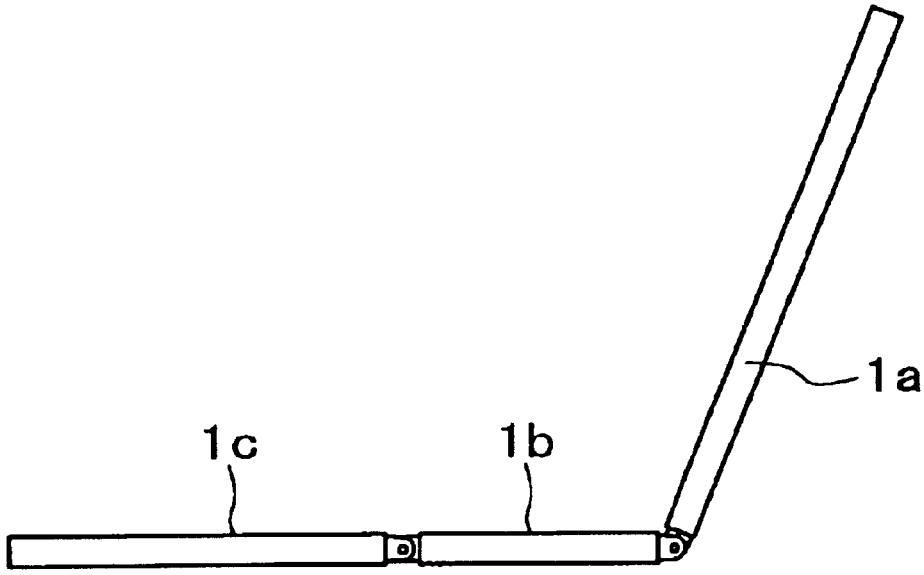
FIG. 8 is a side view showing the entire form of a bottom in a still further other phase in the lifting action, in the case where the method of controlling the coordinative lifting of bottom sections of this invention is applied to a bed.

Then, receiving another command, the controller 6 starts lifting the back bottom section 1*a* at the time instant (t=T1) adequately later than the time instant when the lifting of the knee bottom section 1*b* is started, and thereafter as shown in FIG. 5, both the back bottom section 1*a* and the knee bottom section 1*b* are further lifted.

As described above, for pivotally rotating and lifting the back bottom section 1*a* from a flat state where all the bottom sections are kept down to lie flat, at first, the lifting of the knee bottom section 1*b* is started. Since the knee bottom section 1*b* is lifted, the knee bottom section 1*b* supports the position of the waist of the lying person, and therefore even if the lifting of the back bottom section is started in this state to gradually make the back bottom section steeply inclined, it can be prevented that the lying person is pressed at his/her back to slide forward.

As described before, the lifting of the knee bottom section 1*b* can also be started simultaneously with or later than the lifting of the back bottom section 1*a*.

If the lifting of the back bottom section 1*a* and the lifting of the knee bottom section 1*b* are continued from the state of FIG. 5 further without control, the angle formed between the back bottom section 1*a* and the knee bottom section 1*b* becomes gradually smaller to gradually bend the abdominal region of the lying person, finally letting him/her feel a pressure.

Figure 9:
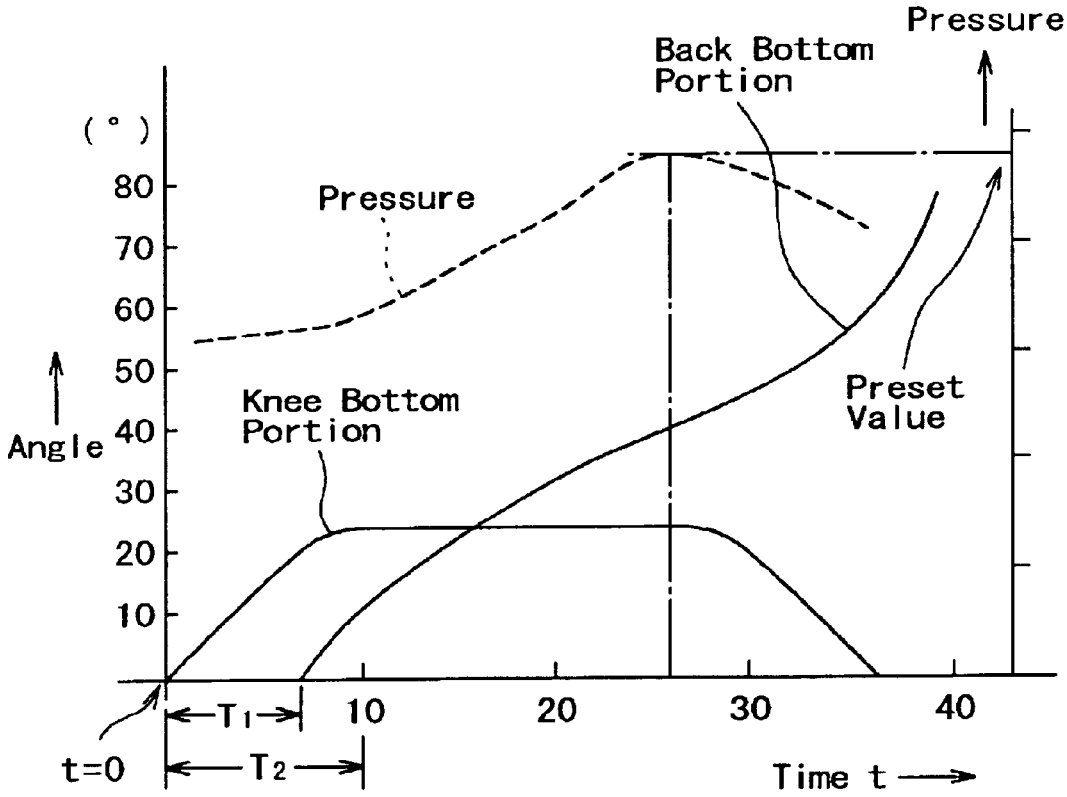
FIG. 9 is a diagram showing an example of how the inclination angles of the back bottom section and the knee bottom section change in relation with the elapsed time, in the case where the method of controlling the coordinative lifting of bottom sections of this invention is applied.

However, in the present invention, the controller 6 keeps monitoring the pressure signals from the pressure detecting means 8 indicated by a broken line in FIG. 9, and if the pressure reaches the pressure preset by the pressure setting means SP, the controller 6 controls to ensure that the lifting of the back bottom section 1*a* is continued, but that the knee bottom section 1*b* is lowered.

Since the knee bottom section 1*b* is lowered like this, even if the back bottom section 1*a* is further lifted to form a sharp angle, the angle of the knee bottom section 1*b* becomes gradually smaller. So, the angle formed between the back bottom section 1*a* and the knee bottom section 1*b* does not become smaller, and therefore it can be prevented that the abdominal region of the lying person is gradually bent between the back bottom section 1*a* and the knee bottom section to let the lying person feel a pressure.

Next, as a first method of detecting the time instant when the lifting of the back bottom section 1*a* is started (T=T1) later than the time instant when the lifting of the knee bottom section 1*b* is started (t=0), and/or the time instant when the knee bottom section 1*b* reaches its highest position (t=T2), to ensure that the controller 6 can carry out the above-mentioned control action in the lifting of the knee bottom section 1*b* and the lifting of the back bottom section 1*a*, the time elapsed from the time instant when the lifting of the knee bottom section 1*b* is started can be referred to for detecting said time instant.

In the case where the capacities of the drive sources such as motors for actuating the lifting mechanisms of the back bottom section 1*a* and the knee bottom section 1*b* are sufficiently larger than the forces necessary for lifting the back bottom section 1*a* and the knee bottom section 1*b* on which the load of the lying person acts, or in the case where the load is constant, there is a constant correlation between the time elapsed after the time instant of actuating a lifting mechanism and the position of the corresponding lifted bottom section 1*a* or 1*b*. So, the elapsed time easy to control can be used to carry out the above-mentioned control action in response to the lifted position of the bottom section 1*a* or 1*b*. So, the elapsed time easy to control can be used to carry out the above-mentioned control action in response to the lifted position of the bottom section 1*a* or 1*b*.

In this case, if it is ensured that the preset values of said time instants T1 and T2 in the controller 6 can be changed, an adequate control action suitable for various conditions such as the person lying on the bottom can be carried out.

As a second method of detecting the time instant when the lifting of the back bottom section 1*a* is started (T=T1) later than the time instant when the lifting of the knee bottom section 1*b* is started (t=0), and/or the time instant when the knee bottom section 1*b* reaches its highest position (t=T2), to ensure that the controller 6 can carry out the above-mentioned control action, a position detecting means such as an angle sensor can be installed for the knee bottom section 1*b*, for detecting the position. The position detecting means for the knee bottom section 1*b* can be installed at an adequate place, for example, the knee bottom section per se, the lifting mechanism or the drive source such as a motor.

Also in this case, if arrangement is made to ensure that the respective portions can be preset, an adequate control action suitable for various conditions such as the person lying on the bottom can be carried out.

The control action of the back bottom section 1*a* and the knee bottom section 1*b* to which this invention is applied has been described as an action in the case where the back bottom section is pivotally rotated and lifted to be kept inclined from a flat state where all the bottom sections are kept down to lie flat. The action in the case where all the bottoms are lowered to be flat from a lifted state where the back bottom section is pivotally rotated and lifted to be most inclined, is reverse to the action explained for the case of lifting. So, the explanation for the latter case of lowering is not made.

But in another embodiment, the action in the case where all the bottoms are lowered to be flat from a lifted state where the back bottom section is pivotally rotated and lifted to be most inclined, maybe different from the reverse action to the action explained for the case of lifting.

Also in the action for lowering, since the knee bottom section lifted to a certain position or the highest position is lowered thereafter, a similar action occurs when the knee bottom section is lowered. So, it can be prevented that the person lying on the bottom slides forward, and when the entire bottom becomes flat, the person lying on the bottom is not displaced. So, the trouble that the caregiver must return the lying person to the original position can be saved.

INDUSTRIAL APPLICABILITY

Since this invention is as described above, the lying furniture such as a bed or stretcher of this invention has a back bottom section for lifting the back portion of a lying person and the knee bottom section for lifting his/her knee portion, and the respective bottom sections can be lifted by the lifting mechanisms installed respectively for them. In this lying furniture, when the back bottom section is pivotally rotated and lifted to be inclined from a flat state where all the bottom sections are kept down to lie flat, the knee bottom is also lifted adequately. In this case, the knee bottom section is controlled to decline when the pressure applied from the back bottom section to the back of the lying person and detected by said pressure detecting means rises to a preset value. Therefore, this invention exhibits the following effects.

a. In this invention, when the back bottom section is pivotally rotated and lifted from a flat state where all the bottom sections are kept down to lie flat, the lifting of the knee bottom section is also started. Since the knee bottom section is lifted, the knee bottom section supports the position of the waist of the lying person. Therefore, even if the lifting of the back bottom section is started to make the back bottom section steeply inclined, it can be prevented that the lying person slides forward.

b. If the lifting of the back bottom section and the lifting of the knee bottom section are continued further without control, the angle formed between the back bottom section and the knee bottom section becomes gradually smaller. So, the abdominal region of the lying person is gradually bent between them, and he/she finally feels a pressure.

c. However, in this invention, the lifting of the knee bottom section is not continued further without control, and said pressure detecting means monitors the pressure applied from the back bottom section to the back of the lying person, so that when the pressure rises to a preset value, the knee bottom section can be controlled to decline. So, it does not happen that the angle formed between the back bottom section and the knee bottom section becomes smaller than a certain angle. Therefore, it can be prevented that the abdominal region of the lying person is gradually bent to let him/her feel a pressure.

What is claimed is:

1. A method of controlling coordinative lifting of bottom sections of lying furniture having a back bottom section for lifting a back portion of a lying person and a knee bottom section for lifting his/her knee portion, in which said bottom sections can be individually lifted and lowered by lifting mechanisms and pressure detecting means being interposed between the back bottom section and back of a lying person, comprising the steps of:

(a) pivotally rotating and lifting the back bottom section and lifting the knee bottom section both from a flat state;

(b) sensing with the pressure detecting means an amount of pressure being exerted against the back of a lying person as the back bottom section and knee bottom sections are lifted, and (c) lowering the knee bottom section when the pressure exerted against the back of a lying person increases to a preset amount.

2. The method of controlling coordinative lifting of bottom sections of lying furniture of claim 1, wherein lifting of the back bottom section and of the knee bottom section is simultaneously initiated.

3. The method of controlling coordinative lifting of bottom sections of lying furniture of claim 1, wherein lifting of the back bottom section is initiated, before lifting of the knee bottom section is begun.

4. The method of controlling coordinative lifting of bottom sections of lying furniture of claim 1, wherein lifting of the knee bottom section is initiated, before lifting of the back bottom section is begun.

5. The method of controlling coordinative lifting of bottom sections of lying furniture of claim 1, further comprising adjusting the preset amount of pressure of the pressure detecting means.

* * * * *